US007232494B2

(12) United States Patent
Rappette

(10) Patent No.: US 7,232,494 B2
(45) Date of Patent: Jun. 19, 2007

(54) STOP START WASH CYCLE FOR DISHWASHERS

(75) Inventor: Antony Mark Rappette, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 363 days.

(21) Appl. No.: 10/236,412

(22) Filed: Sep. 6, 2002

(65) Prior Publication Data

US 2004/0045586 A1 Mar. 11, 2004

(51) Int. Cl.
*B08B 7/00* (2006.01)
*B08B 3/00* (2006.01)

(52) U.S. Cl. ..... 134/18; 134/10; 134/25.2; 134/95.3; 134/184; 134/186

(58) Field of Classification Search ..... 134/25.2, 134/184, 186, 95.3, 10, 18
See application file for complete search history.

(56) References Cited

U.S. PATENT DOCUMENTS

| | | | | |
|---|---|---|---|---|
| 3,070,714 | A | 12/1962 | Jacobs | 307/141 |
| 3,199,525 | A | 8/1965 | Jellies | 137/107 |
| 3,600,602 | A | 8/1971 | Yartz | 307/141.8 |
| 3,669,132 | A | 6/1972 | Mamrose | 134/58 D |
| 3,835,880 | A | 9/1974 | Hoffman et al. | 137/387 |
| 4,106,517 | A | 8/1978 | Wright | 134/58 D |
| 4,347,861 | A | 9/1982 | Clearman et al. | 134/104 |
| 4,559,959 | A | 12/1985 | Meyers | 134/56 D |
| 5,097,855 | A | 3/1992 | Martinsson et al. | 134/57 D |
| 5,429,679 | A | 7/1995 | Young, Jr. | 134/25.2 |
| 5,494,062 | A | 2/1996 | Springer | 134/58 D |
| 5,525,161 | A * | 6/1996 | Milocco et al. | 134/18 |
| 5,545,259 | A * | 8/1996 | Suzuki et al. | 134/18 |
| 5,601,660 | A | 2/1997 | Jeon et al. | 134/10 |
| 5,669,983 | A | 9/1997 | Cooper et al. | 134/18 |
| 5,711,325 | A | 1/1998 | Kloss et al. | 134/104.1 |
| 5,762,080 | A * | 6/1998 | Edwards et al. | 134/58 D |
| 5,837,151 | A | 11/1998 | Jozwiak | 210/787 |
| 6,138,692 | A | 10/2000 | Kobos et al. | 134/25.2 |
| 6,182,674 | B1 | 2/2001 | Jozwiak et al. | 134/56 |
| 6,418,943 | B1 | 7/2002 | Miller | 134/104.1 |
| 6,431,188 | B1 | 8/2002 | Laszczewski, Jr. et al. | 134/56 D |
| 2004/0159339 | A1 * | 8/2004 | Elick et al. | 134/25.2 |

OTHER PUBLICATIONS

Patent Abstract of Japan Patent No. JP6054789, Publication date Mar. 1, 1994.

* cited by examiner

*Primary Examiner*—Zeinab El-Arini
(74) *Attorney, Agent, or Firm*—Michael D. Lafrenz; John Morrison

(57) ABSTRACT

A method of washing dishes in a dishwasher that includes a Start Stop sequence in a wash segment of one or more of the dishwashing cycles. The Stop Start sequence includes the steps of pausing the operation of the wash pump, operating the wash pump to circulate wash water in the dishwasher for a short period of time, and repeating the steps of pausing and operating the wash pump for a short period of time a predetermined number of times. The Stop Start sequence is preceded by, and may be followed by, a period of continuous operation of the wash pump.

16 Claims, 6 Drawing Sheets

STOP START WASH CYCLE FOR DISHWASHERS

BACKGROUND OF THE INVENTION

1. Field of the Invention

The present invention is directed to a wash cycle for a dishwasher.

DETAILED DESCRIPTION

Figure 1:
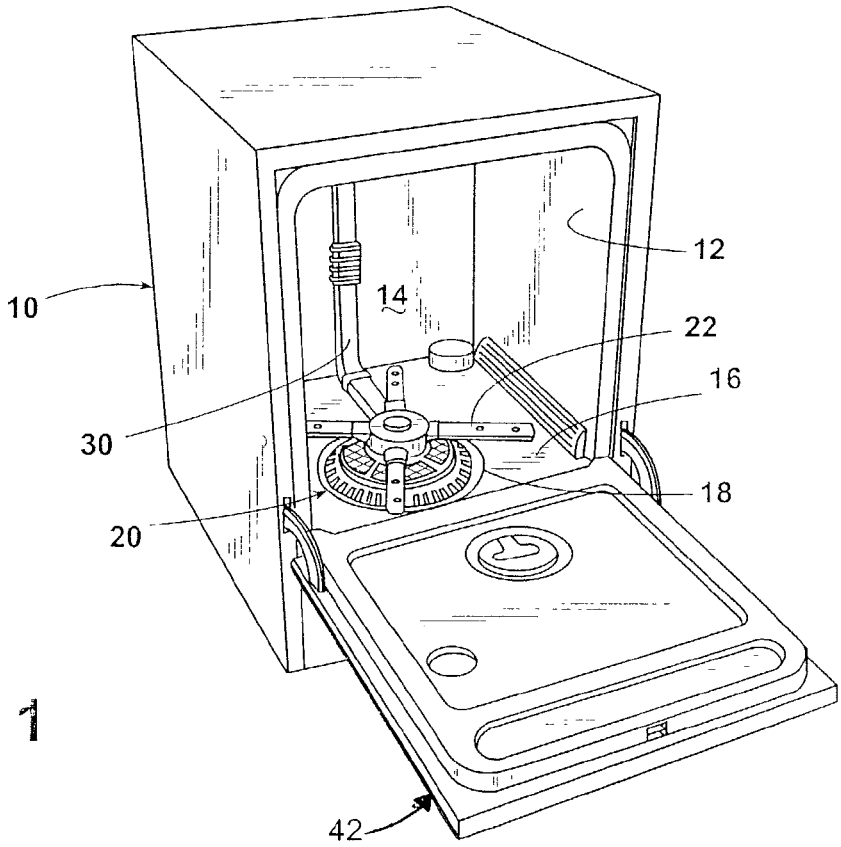
FIG. 1 is a perspective view of a dishwasher for carrying out the invention.
Figure 2:
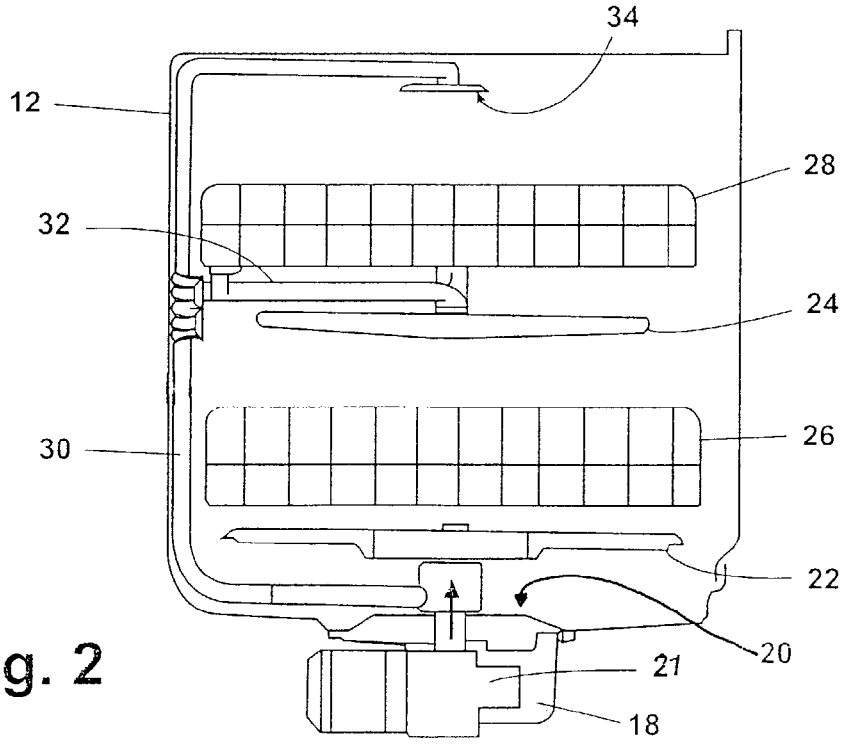
FIG. 2 is a schematic, cross-sectional view of the dishwasher of FIG. 1, showing the dishracks mounted within the tub and the spray arm feed system.

In accordance with the invention as shown in the drawings, and particularly as shown in FIGS. 1 and 2, an automatic dishwasher generally designated 10 includes an interior tub 12 forming an interior wash chamber or dishwashing space 14. The tub 12 includes a sloped bottom wall 16 that defines a lower tub region or sump 18 of the tub. A pump assembly 20 is located in the bottom wall 16 and operates to draw wash liquid from the sump and pump it to a lower spray arm assembly 22, a mid-level spray arm assembly 24 and an upper spray arm assembly 34. The lower spray arm 22 is positioned beneath lower dishware rack 26 and the mid-level spray arm assembly 24 is associated or positioned below a dishware rack or basket 28.

The lower spray arm assembly 22 may be mounted to the upper portion of the pump assembly 20 and receive wash liquid from the pump. Since the mid level spray arm assembly 24 and upper spray assembly 34 are remote from the pump, means must be provided to supply wash liquid remotely to these upper spray devices 24 and 34. To that end, a supply tube 30 extends generally rearwardly from the pump assembly 20 to the rear wall of the tub and then runs upwardly to supply wash liquid to upper spray devices 24 and 34. The spray arm feed system construction and operation is explained in U.S. Pat. No. 6,431,188 to Laszczewski et al, entitled "DISHWASHER SPRAY ARM FEED SYSTEM", herein incorporated by reference. In that patent, the spray arm feed system is fully explained.

Figure 3:
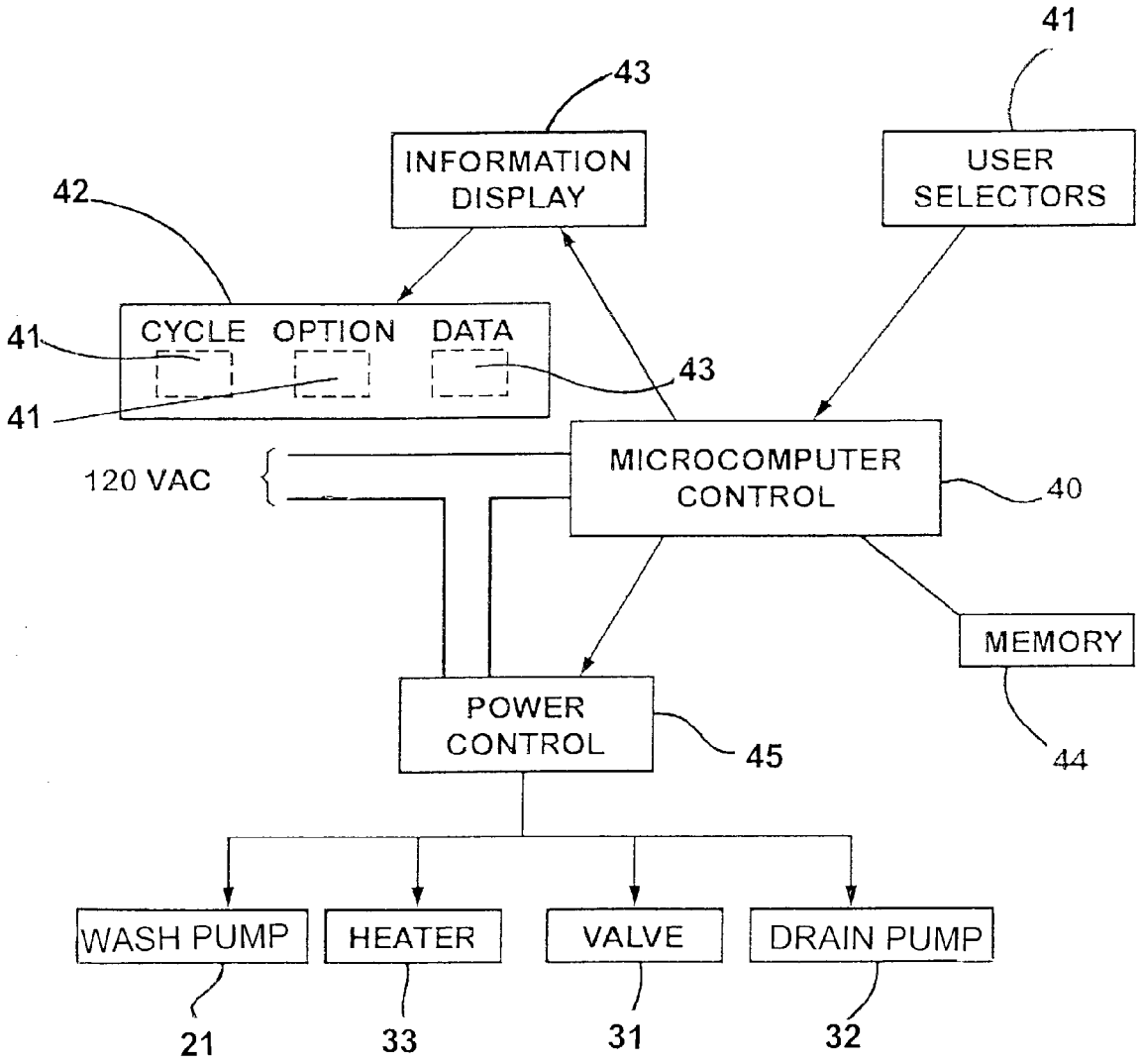
FIG. 3 is a simplified block diagram of a dishwasher control system employed for carrying out the invention.

As shown in FIG. 3, the operation of the wash pump motor 21 within the dishwasher, together with other components such as a heater 33, inlet valve 31, and a drain pump motor 32 to carry out a number of different preprogrammed automatic cycles are operated by a control device that, in this embodiment, comprises a microcomputer control 40. The microcomputer control 40 can be located in the control console of the door, or elsewhere in the dishwasher. The microcomputer control 40 receives as inputs user selections entered manually by the user at selectors 41 that can be mounted on the console 42. The information obtained by the microcomputer control 40 from the console 42 is typically in the form of digital signals developed as a function of the status of the switches involved. The microprocessor control 40 may receive signals from sensors or other components of the dishwasher as is well known to those skilled in the art. The particular cycle and option selected by the user as well as other data are displayed to the user by a display unit 43 that may comprise a light emitting diode (LED) display controlled by digital signals supplied to it by the microcomputer control 40.

The wash pump motor 21 and other electrically operated components of the dishwasher are all controlled by the microcomputer control 40 through a power controller 45 that may comprise a set of electromechanical relays or other power controlling devices such as silicon controlled rectifiers (SCRs) or Triacs. Power controller 45 may be located in the console 42, but can be located elsewhere in the dishwasher as is well known to those skilled in the art.

The microcomputer control 40 may be of any conventional type, and can be formed on an integrated circuit. The dishwasher cycles are programmed in a memory 44 addressable by the microcomputer control 40.

Figure 4:
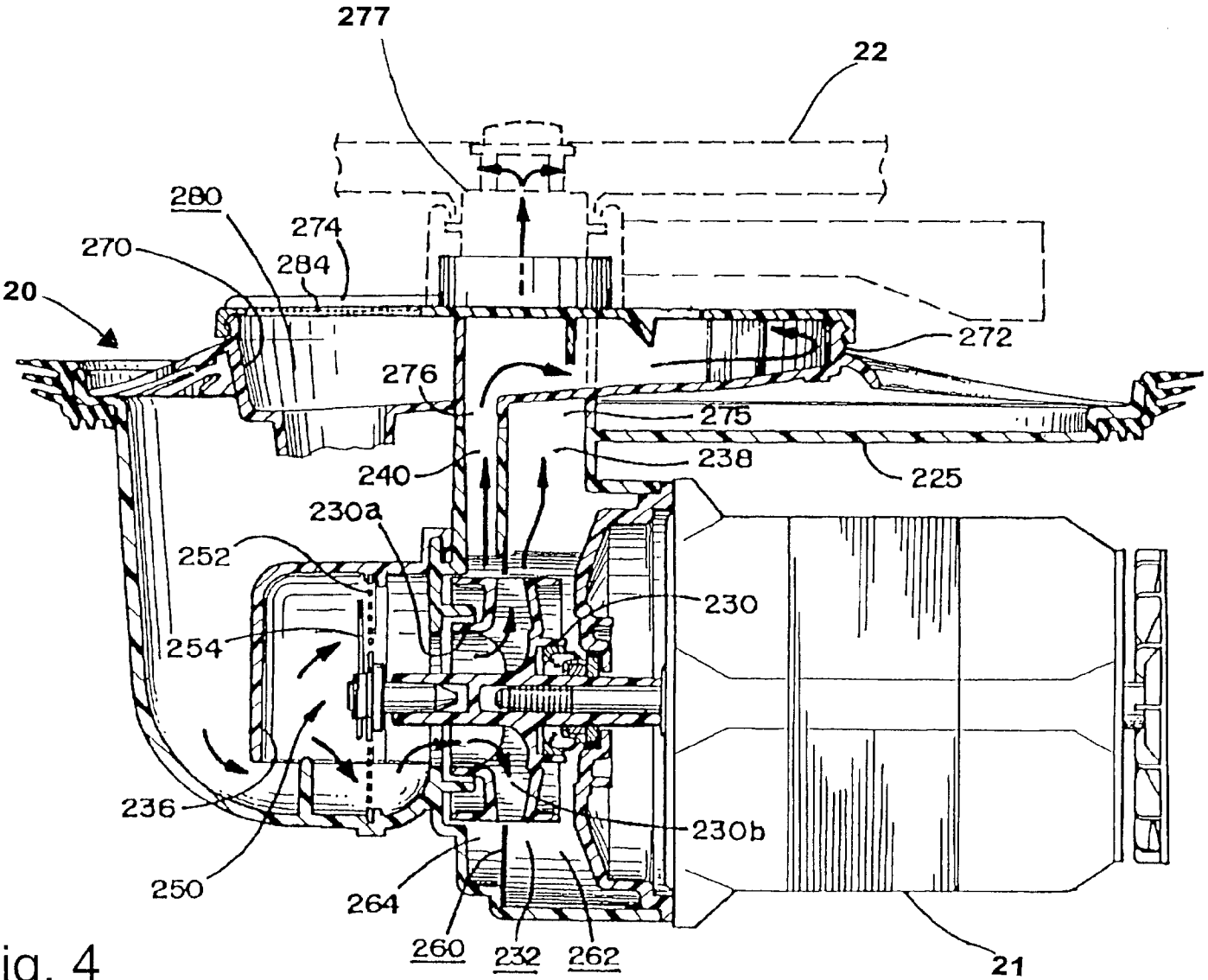
FIG. 4 is a sectional view of the pump assembly used in conjunction with the invention, illustrating fluid flow through the wash pump to the spray arms and to the soil separator.
Figure 5:
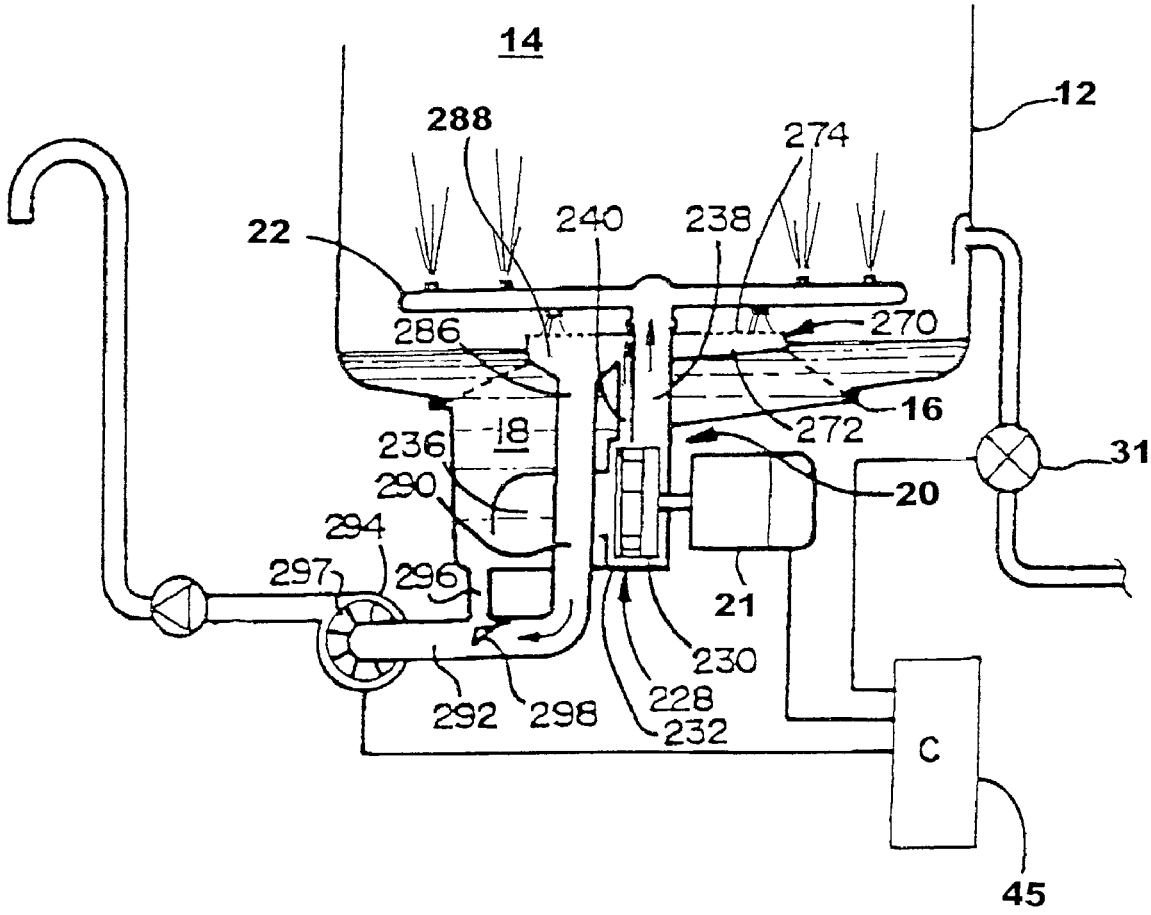
FIG. 5 is a schematic illustration of the pump and soil separation and collection system of the pump assembly used in conjunction with the invention and illustrating fluid flow to drain.

Referring to FIG. 4 and FIG. 5 it can be understood that the pump assembly 20 includes a wash pump chamber 232, the pump inlet 236, the main outlet 238 and the secondary outlet 240 that can be formed in part by a member 225 which forms part of the tub bottom 16. While this structure is shown as a particular embodiment of the invention, it is clearly just one example of how the present invention may be practiced.

Wash liquid drawn into the pump inlet 236 passes through a chopper assembly 250. The chopper assembly includes a sizing plate 252 and a chopper blade 254. The chopper blade 254 rotates adjacent the sizing plate 252 and chops food particles entrained within the wash liquid to size sufficient to allow the food particles to pass through the sizing plate. After being chopped and sized by the chopper assembly 250, the soils are drawn, along with the wash liquid, into the pump chamber 232.

Within the pump chamber 232, the soils are partially separated and concentrated by the operation of a filter plate 260 located within the pump chamber 232. The filter plate 260 is a flat filter with an inner diameter (I.D.) greater than the outer diameter (O.D.) of the wash impeller 230 and which is located about the wash impeller 230 perpendicular to the axis of rotation of the wash impeller 230. The filter plate 260 separates the pump chamber into first region or side 262 and a second region or side 264. During the dishwasher operation, wash liquid is drawn through the pump inlet 236, into the eye of the wash impeller 230*a*, and is moved outwardly from the center of the impeller 230 by the impeller vanes 230*b*.

Wash liquid coming off of the impeller 230 is divided into two portions by the filter plate 260 such that a first portion passes from the impeller into the first region 262 of the pump chamber 232 and a second portion passes from the impeller into the second region 264 of the pump chamber 232. The main outlet 238 provides an outlet for the first region 262 of the pump chamber 232. The secondary outlet 240 provides an outlet for secondary region 264 of the pump chamber 232. The secondary outlet 240 is sized relatively small such that when the wash impeller 230 is pumping wash liquid, the pressure in second region 264 of the pump chamber 232 is greater than the pressure in the first region 262 of the pump chamber 232. The pressure difference across the filter plate 260 is caused by the fact that the ratio of the first portion of wash liquid pumped from the impeller 230 into the first region 262 to the second portion of wash liquid pumped from the impeller 230 into the second region 264 is greater than the ratio of the size of the main outlet 238 to the size of the secondary outlet 240.

It can be understood, therefore, that a portion of the wash liquid coming off the wash impeller 230 into the second region 264 of the pump chamber 232 passes through the secondary outlet 240 and the remainder passes through the filter plate 260 traveling from the second region 264 of the pump chamber 232 into the first region 262 of the pump chamber 232. This flow through the filter plate 260 from the second region 264 to the first region 262 results in the filtering of soils and a concentrating of soil in the second region 264 such that the wash liquid sent through the secondary outlet 240 has a concentration of soils greater than the concentration of soils in the wash liquid being drawn into the eye of the pump impeller, at least for a first portion of the wash cycle.

Wash liquid and entrained soils flow, therefore, through the secondary outlet 240 into the soil collector 270. As shown in FIG. 4, the soil collector includes a main body 272 and a top panel 274. The main body 272 is a generally circular, cup-like member which is secured to the bottom wall 16 of the wash tub 12. The main body 272 includes an outer flange that forms a coarse grate through which wash liquid flows on its path toward the pump inlet 236. The main body 272 has a center opening or conduit 275 that receives fluid flow from the main outlet 238 of the pump chamber 232. A bearing hub 277 may be partially positioned in the center conduit 275 for directing wash liquid to the spray arm assembly 22. The main body further includes an inlet 276 for receiving wash liquid from the secondary outlet 240.

The main body 272 further includes a downwardly projected portion 286 that defines a soil accumulation region or sump 288 for the soil collector 270. As the soil laden wash liquid proceeds within the separation channel 280, water passes upwardly through the filter screen panel 284 leaving the soils within the separation channel 280. Within the soil separation channel 280, soils are directed to generally accumulate in the soil accumulation region or sump 288.

As shown in FIG. 5, a drain pump 294, separate from the wash pump 228, is provided for draining wash liquid from the dishwasher tub 12. The drain pump 294 includes a drain motor 32 drivingly connected to a drain impeller 297 located within a housing. Located at the bottom of the downwardly projected portion 286 is an outlet opening 290 that is fluidly connected with an inlet area 292 for the drain pump 294. An opening 296 is also provided into the inlet area 292 from the sump 18. A flapper type check valve 298 is provided at the opening 296 for selectively controlling the flow of liquid from the sump 18 into the inlet area 292 of the drain pump 294 based on the pressure difference across the valve 298. Preferably, when the wash pump 228 is operating, pumping fluid into the soil collector 270 and pressurizing the inlet area 292, the pressure in the inlet area 292 will be greater than the sump 18 such that the valve 298 will be closed. When the wash pump 228 is not pressurizing the inlet area 292, the flapper may open to allow wash liquid to flow from the sump 18 into the inlet area 292. The pump assembly 20 construction and operation is explained in U.S. Pat. No. 6,418,943, to Miller, entitled "WASH LIQUID CIRCULATION SYSTEM FOR A DISHWASHER", herein incorporated by reference. In that patent, the operation of the wash liquid recirculation system, the constructional features and operation of the pump assembly and soil collector as well as the drain mode of the pump assembly are explained.

The pump assembly 20 and microcomputer control 40 can be arranged to provide an automatic purge system. The automatic purge system is explained in U.S. Pat. No. 6,182,674, to Jozwiak et al, entitled "PUMP AND SOIL COLLECTION SYSTEM FOR A DISHWASHER", herein incorporated by reference. The operation of the automatic purge filtration system (apf) can operate in conjunction with the drain pump 294 of the pump assembly 20 under the control of the microprocessor control 40. As explained in the '674 patent the apf includes a pressure switch, not shown, for sensing the pressure within the soil collector. When the pressure within the soil collector exceeds a predetermined limit level, the drain pump 294 is energized by the microcomputer control 40 through the power controller 45 such that soils are cleared or purged from the soil collector. This operation may be repeated as many times as needed during a step in a cycle when the apf mode is enabled by the microprocessor control 40.

Figure 6:
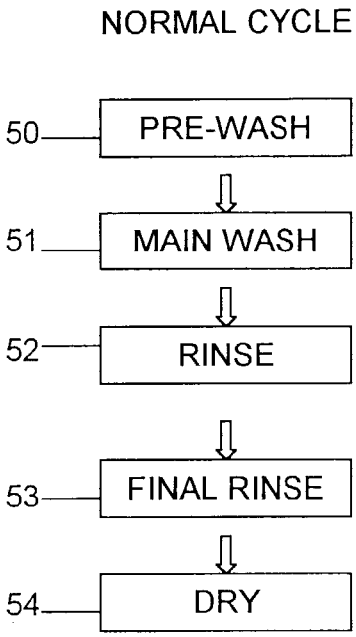
FIG. 6 is a flow chart of the operation of a dishwasher in a normal cycle according to one embodiment of the invention.

Referring to the embodiment of FIG. 6 and FIG. 7, the dishwasher program according to the invention operates the dishwasher in the following manner. Referring to FIG. 6, a normal wash cycle can include Pre-Wash 50, Main Wash 51, Rinse 52, Final Rinse 53 and Dry 54 segments. Each of the segments can include one or more steps such as Fill, Pause, Pump, Drain, Heat, and others. As is well known to those skilled in the art a normal wash cycle can include an additional segment or segments such as an additional rinse segment. For example, an additional rinse could be added after Rinse 52 at the user's option, or preprogrammed in the microcomputer control. The normal wash cycle, as well as other preprogrammed cycles, can be programmed in the microcomputer control 40. As is well known to those skilled in the art the microcomputer control 40 causes the power control 45 to energize the pump motor 21, heater 33, valve 31 and/or drain pump motor 32 and other components such as dispensers to cause the dishwasher to perform the steps required to deliver the preprogrammed cycle. In a Fill step the microcomputer causes the fill valve 31 to be energized allowing water to flow into the dishwasher. In a Pause step all the operating components, pump motors, heater and the like are de-energized. In a Pump step the wash pump motor 21 is energized causing the wash pump 228 to circulate wash water through the dishwasher. In a step including Heat, the heater element 33 is energized to heat wash water in the sump 18. In a Drain step the drain pump motor 32 is energized causing drain pump 294 to pump wash water to drain. In a Pump & Heat & Detergent step the wash pump motor 21 and heater element 33 are energized to heat and circulate wash water in the dishwasher and detergent is dispensed into the dishwasher. In a Pump & Heat—Thermal Hold step the wash pump motor 21 and heater 33 are energized to circulate heated wash water in the dishwasher until a predetermined temperature is detected by a thermal sensor, not shown, sensing the temperature of the wash water. A Pump & Heat—Thermal Hold step can be arranged to be of indefinite duration determined by detection of a predetermined temperature, or may have a limit to the duration determined by the microcomputer control 40 as is well known to those skilled in the art.

A Stop Start Wash sequence according to the invention in this embodiment occurs in the Main Wash segment 51. Referring to FIG. 7, Main Wash segment 51 includes Fill 60, Pause 61, Pump & Heat & Detergent 62, Pump & Heat—Thermal Hold 63, Pause 64, Pump 65, Pump 66, Drain and Pump 67 and Drain 68 steps as described above. In this embodiment Pump & Heat—Thermal Hold segment 63 includes activation of the apf mode. The Pause 64 and Pump 65 steps are repeated a number of times to provide the Stop Start Wash sequence in Main Wash segment 51.

The duration of Pause step 64 is sufficient for the wash pump 228 to stop and allow wash water being circulated in supply tube 30 to drain back into the pump assembly 20. As wash water in supply tube 30 drains back into the pump assembly 20 soil particles collected on the food chopper sizing plate 252 and filter plate 260 in the pump chamber 232 are flushed off the respective plates. When Pump step 65 begins following Pause step 64 the resumption of wash water flow through the pump assembly 20 provides a new opportunity for food particles to be washed into the soil collector 270. The Pause step 64 can be 15 seconds long. The duration of Pause step 64 can be longer or shorter than 15 seconds, for example 10 to 20 seconds long. Thus, one of the advantages of the invention is improved movement of soil particles into the soil collector to reduce the amount of soil particles recirculated in the wash water.

When Pump step 65 begins there is a surge of wash water through the distribution system including supply tube 30 and spray arms 22, 24 and 34. The surge of wash water at the beginning of Pump step 65 provides extra scrubbing energy to dislodge soil particles still present on ware being washed in the dishwasher. Thus, another advantage of the Start Stop Wash sequence is an increase in the number of pump starts at the beginning of each Pump step. Pump step 65 can be 45 seconds long. The duration of Pump step 65 can be longer or shorter than 45 seconds, for example 30 to 90 seconds long.

Figure 7:
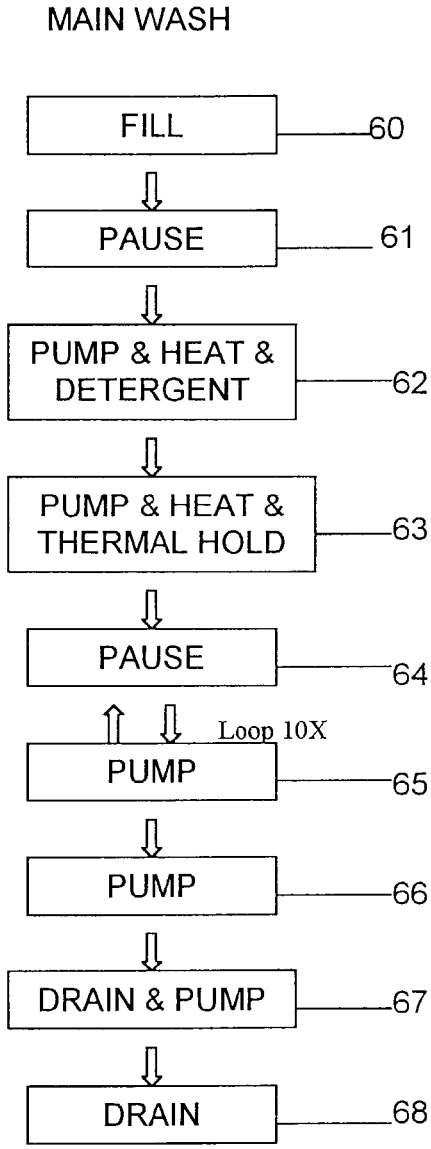
FIG. 7 is a flow chart of the operation of a dishwasher during the main wash segment of the normal cycle illustrated in FIG. 6.

In the embodiment of FIG. 7 the Pause 64 and Pump 65 steps are repeated 10 times to provide the Stop Start Wash sequence. The number of repeats or loops in the Stop Start Wash sequence can be more or less than 10 times. Following is a table setting forth an example of the duration of each of the steps in the Main Wash segment 51 and when automatic purge filtration, apf, is enabled.

| | Time (minutes) | |
|---|---|---|
| Fill 60 | 1:35 | |
| Pause 61 | 0:05 | |
| Pump & Heat & Detergent 62 | 0:45 | |
| Pump & Heat 63 | Thermal Hold | (apf) |
| Pause 64 | 0:15 | loop |
| Pump 65 | 0:45 | 10X |
| Pump 66 | 12:30 | |
| Drain & Pump 67 | 1:00 | |
| Drain 68 | 1:00 | |

It will be appreciated by those skilled in the art that the times for the steps in the embodiment shown above can be adjusted to be longer or shorted as desired. In addition, as mentioned above, the Thermal Hold in Pump & Heat step 63 can be limited by the microcomputer control 40 if desired, or be determined by the time required to heat the recirculating wash water to the predetermined temperature. The inventive method described in this embodiment can be employed in other dishwasher cycles.

Figure 8:
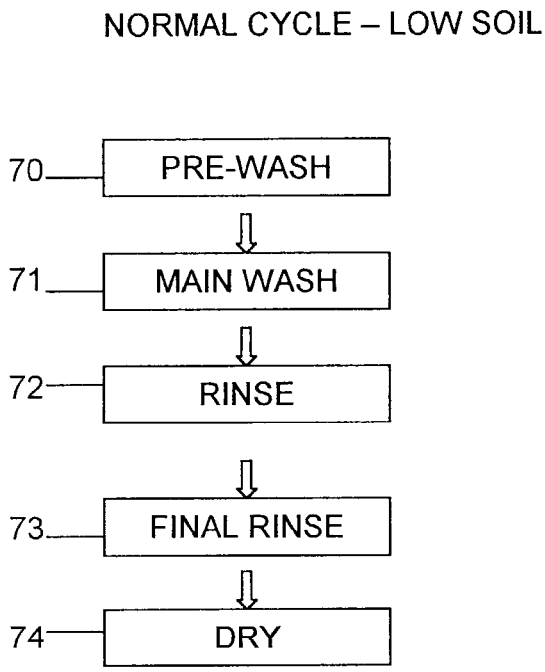
FIG. 8 is a flow chart of the operation of a dishwasher in a normal cycle—light soil cycle according to another embodiment of the invention.
Figure 9:
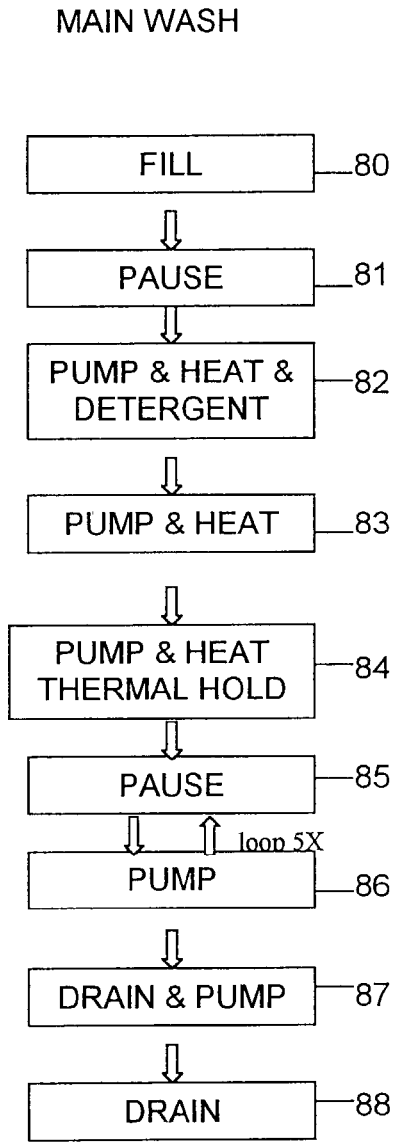
FIG. 9 is a flow chart of the operation of a dishwasher during the main wash segment of the normal cycle—light soil illustrated in FIG. 8.

Turning to FIG. 8 and FIG. 9 another embodiment of the inventive dishwasher cycle is shown. In FIG. 8 a normal wash cycle for low soil is shown. In this embodiment the normal cycle—low soil cycle includes Pre-Wash 70, Main Wash 71, Rinse 72, Final Rinse 73 and Dry 74 segments. Each of the segments can include one or more steps such as Fill, Pause, Pump, Drain, Heat, and others. The normal wash—low soil cycle can be programmed in the microcomputer control 40. In this embodiment the Stop Start Wash sequence according to the invention occurs in the Main Wash segment 71. Referring to FIG. 9, Main Wash segment 71 includes Fill 80, Pause 81, Pump & Heat & Detergent 82, Pump & Heat 83, Pump & Heat—Thermal Hold 84, Pause 85, Pump 86, Drain & Pump 87 and Drain 88 steps. The operation of the dishwasher in these steps is the same as described above in connection with the embodiment of FIG. 6 and FIG. 7. In this embodiment automatic purge filtration (apf) is provided in the Pump & Heat 83, and Pump & Heat—Thermal Hold 84 steps. As in the previous embodiment, the Pause 85 and Pump 86 steps are repeated a number of times to provide the Stop Start Wash sequence in Main Wash segment 71. In this embodiment the Start Stop Wash sequence is provided at the end of the Main Wash segment rather than at the beginning of Main Wash segment 51 of the previous embodiment.

The function of the Start Stop Wash sequence in this embodiment is the same as in the previous embodiment. The duration of Pause step 85 is sufficient for the wash pump 228 to stop and allow wash water in supply tube 30 to drain back into the pump assembly 20. The Pause step 85 can be 15 seconds long. The duration of Pause step 85 can be longer or shorter than 15 seconds, for example 10 to 20 seconds long. As in the previous embodiments, one of the advantages of the invention is improved movement of soil particles into the soil collector to reduce the amount of soil particles recirculated in the wash water.

When Pump step 86 begins there is a surge of wash water through the distribution system including the supply tube 30 and spray arms 22, 24 and 34. The surge of wash water at the beginning of Pump step 86 provides extra scrubbing energy to dislodge soil particles still present on ware being washed in the dishwasher. As in the previous embodiment, another advantage of the Start Stop Wash sequence is an increase in the number of pump starts at the beginning of each Pump step, such as Pump step 86. Pump step 86 can be 45 seconds long. The duration of Pump step 86 can be longer or shorter than 45 seconds, for example 30 to 90 seconds long.

In the embodiment of FIG. 9 the Pause 85 and Pump 86 steps are repeated 5 times to provide the Stop Start Wash sequence. The number of repeats may be more or less than 5 times. In this embodiment the duration of the steps of the Main Wash segment 71 and enablement of the apf mode by the microcomputer control can be as follows.

| | Time (minutes) | |
|---|---|---|
| Fill 80 | 1:35 | |
| Pause 81 | 0:05 | |
| Pump & Heat & Detergent 82 | 0:45 | |
| Pump & Heat 83 | 7:00 | (apf) |

-continued

| | Time (minutes) | |
|---|---|---|
| Pump & Heat 84 | Thermal Hold | (apf) |
| Pause 85 | 0:15 | loop |
| Pump 86 | 0:45 | 5X |
| Drain & Pump 87 | 1:00 | |
| Drain 88 | 1:00 | |

It will be appreciated by those skilled in the art that the times for the steps in the embodiment shown above can be adjusted to be longer or shorted as desired.

Although the description of the two embodiments above are of a "normal" wash cycle, other wash cycles (i.e. heavy soil, pots and pans, etc.) could be used without departing from the scope of the present invention. Typically, these other cycles differ from a "normal" cycle in that more, or longer or shorter wash and/or rinse cycles are employed.

While the invention has been specifically described in connection with certain specific embodiments thereof, it is to be understood that this is by way of illustration and not of limitation, and the scope of the appended claims should be construed as broadly as the prior art will permit.

I claim:

1. A method of washing soil particles from dishes in a dishwasher comprising a tub defining a wash chamber, a distribution system for distributing wash liquid to the wash chamber, a drain system for draining wash liquid from the wash chamber; and a wash pump having a pump chamber housing a filter system fluidly coupled to the pump, the distribution system, and the drain system, the method comprising the steps of:

operating the wash pump for a first time interval to circulate wash liquid through the distribution system to the wash chamber during a wash segment of a wash cycle;

pausing the operation of the wash pump during the wash segment for a second time interval to allow wash liquid in the distribution system to flow back into the pump chamber to flush the filter system; and operating the wash pump for a third time interval during the wash segment to remove soil particles from the wash liquid into the drain system.

2. The method of washing dishes in a dishwasher of claim 1 wherein the step of operating the wash pump is longer than the step of pausing the operation of the wash pump.

3. The method of washing dishes in a dishwasher of claim 1 wherein the step of pausing operation of the wash pump extends for approximately 15 seconds and the step of operating the wash pump extends for approximately 45 seconds.

4. The method of washing dishes in a dishwasher of claim 3 wherein the steps of pausing and operating the wash pump are repeated at least 5 times.

5. The method of washing dishes in a dishwasher of claim 4 wherein the steps of pausing and operating the wash pump are repeated at least 10 times.

6. A method of washing dishes in a dishwasher comprising a tub defining a wash chamber, a distribution system for distributing liquid to the wash chamber, and a wash pump having a pump chamber for recirculating wash liquid through the distribution system, the method comprising the steps of:

A) operating the wash pump for a first time interval to circulate wash liquid through the distribution system to the wash chamber during a wash segment of a wash cycle;

B) pausing the operation of the wash pump during the wash segment for a second time interval shorter than the first time interval to allow wash liquid in the distribution system to flow back into the pump chamber; and C) repeating steps A) and B) without an intervening step to provide a stop-start wash sequence during the wash segment.

7. The method of washing dishes in a dishwasher of claim 6 wherein the step of operating the wash pump is between 2 and 4 times as long as the step of pausing the operation of the wash pump.

8. The method of washing dishes in a dishwasher of claim 7 wherein the steps of pausing the operation of the wash pump and operating the wash pump are repeated between 5 and 15 times in the stop-start wash sequence.

9. The method of washing dishes in a dishwasher of claim 8 wherein the wash segment further comprises at least one of preceding and following the stop-start wash sequence with a step of operating the wash pump continuously.

10. The method of washing dishes in a dishwasher of claim 9 wherein when the stop-start wash sequence is preceded with a step of operating the wash pump continuously, the wash segment ends after the stop-start wash sequence.

11. The method of washing dishes in a dishwasher of claim 9 wherein the stop-start wash sequence is preceded by operating the wash pump continuously, and the stop-start wash sequence is followed by operating the wash pump continuously for the remainder of the wash segment.

12. The method of washing dishes in a dishwasher of claim 6 wherein the step of pausing operation of the wash pump extends for approximately 15 seconds and the step of operating the wash pump extends for approximately 45 seconds.

13. The method of washing dishes in a dishwasher of claim 12 wherein the steps of pausing and operating the wash pump are repeated at least 5 times.

14. The method of washing dishes in a dishwasher of claim 13 wherein the steps of pausing and operating the wash pump are repeated at least 10 times.

15. The method of washing dishes in a dishwasher of claim 6, wherein the dishwasher further comprises a filter system fluidly coupled to the pump and the distribution system and wherein the pausing of the operation of the wash pump permits the wash water flowing back from the distribution system to flush the filter system.

16. The method of washing dishes in a dishwasher of claim 15 wherein the repeating of the pausing and operating of the pump provides a plurality of surges of wash water through the distribution system and into the wash chamber to improve removal of food particles from dishes being washed.

* * * * *